United States Patent [19]

Miller

[11] 4,455,772

[45] Jun. 26, 1984

[54] MEMORIAL DISPLAY CASE

[76] Inventor: Claudette R. Miller, 7337 S. Shore, #525, Chicago, Ill. 60649

[21] Appl. No.: 377,951

[22] Filed: May 13, 1982

[51] Int. Cl.[3] ..... G09F 19/00

[52] U.S. Cl. ..... 40/124.5

[58] Field of Search ..... 40/152.2, 160, 124.5, 40/564, 541, 572, 573, 574, 575, 576, 577, 578, 581, 563, 553, 158 B; 362/806, 812; 428/3, 7; 206/19; 52/104

[56] References Cited

U.S. PATENT DOCUMENTS 1,612,357 12/1926 Brown ..... 40/124.5

2,242,040 5/1941 Murphy ..... 428/3

3,543,426 12/1970 Sakamoto ..... 40/158 B 4,249,328 2/1981 Plumadore ..... 40/158 B

*Primary Examiner*—Robert Peshock

*Assistant Examiner*—Cary E. Stone

*Attorney, Agent, or Firm*—Jack C. Munro

[57] ABSTRACT

A memorial display case which includes two separate compartments which are separated by a cruciform. Each compartment has an access opening. Each access opening is closed by a sliding transparent panel. Each compartment is adapted to hold articles, such as flowers or writings.

3 Claims, 8 Drawing Figures

Fig.1.
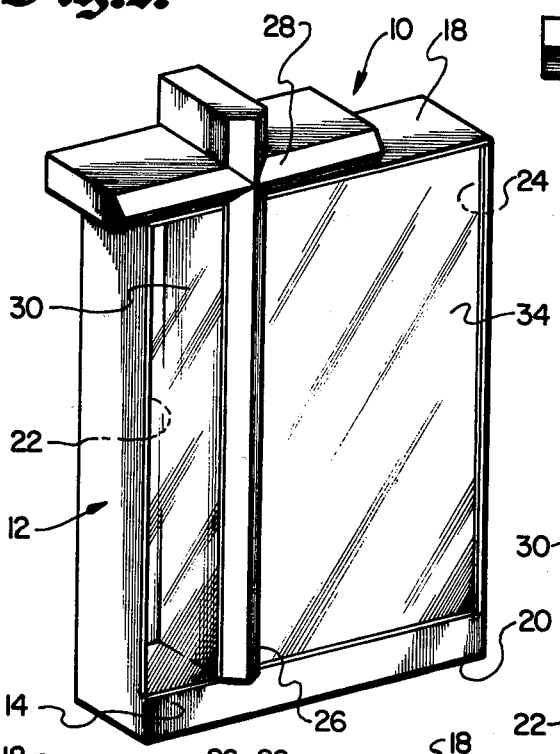
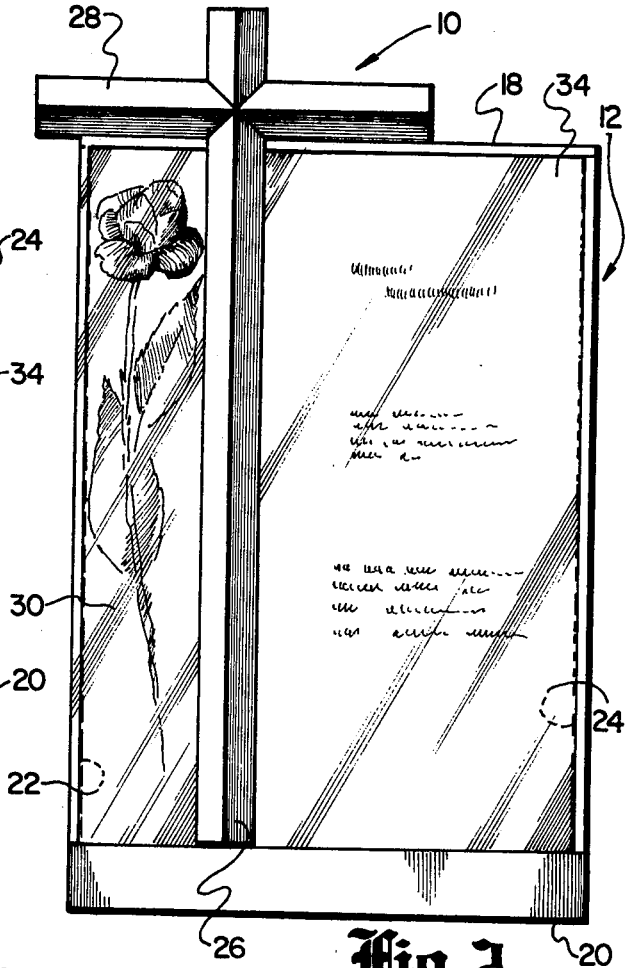
Fig.2.
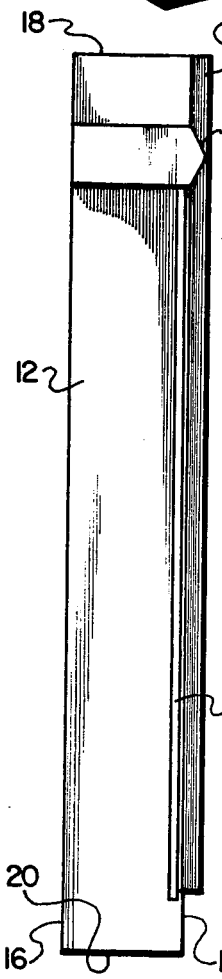
Fig.3.
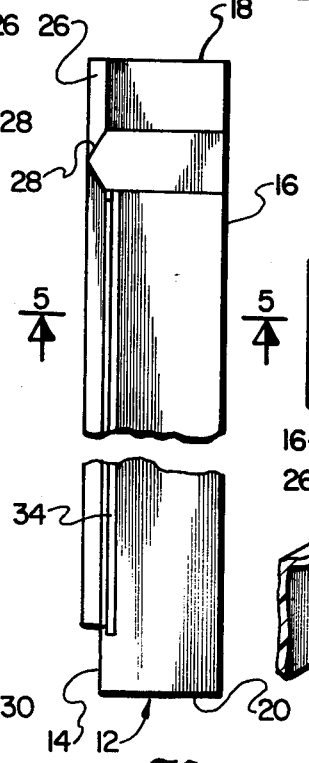
Fig.4.
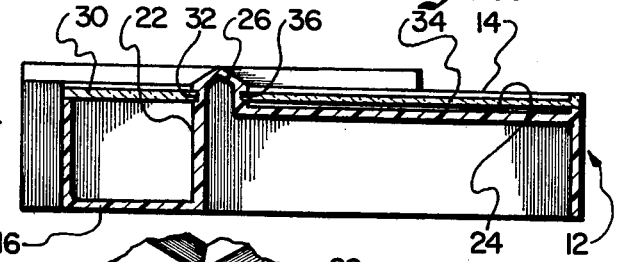
Fig.5.
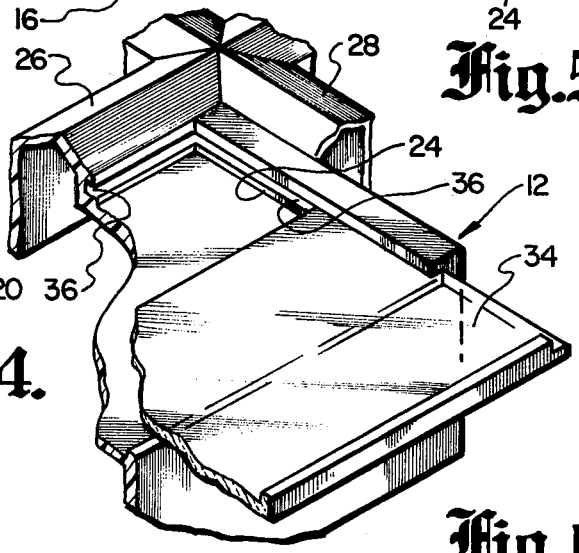
Fig.6.

MEMORIAL DISPLAY CASE

BACKGROUND OF THE INVENTION

The field of this invention relates to display cases and more particularly to a display case which is to be used as a commemorative at a funeral and may be retained by the family for use at home. A secondary use may be at a grave site.

The normal procedure at funerals and grave sites is that any written notices, flowers or other memorabilia are placed on tables, the ground or other supportive surface. Prior to the present invention, there has not been known any type of a case which facilitated the display in an attractive, respectful manner of flowers, pertinent written material or memorabilia for the deceased which the family could use to commemorate at home.

SUMMARY OF THE INVENTION

The memorial display case of the subject invention is constructed of a housing which is divided into a first and a second compartment by the upright, elongated member of a cruciform. Each of the compartments include an access opening within the front surface of the housing. Each of the access openings are normally closed by means of a transparent window which is slidably removable from the housing in order to provide for access into each of the compartments. Optionally, the cruciform may include a lighting means to illuminate each of the compartments. Normally the compartments will be different in size.

BRIEF DESCRIPTION OF THE DRAWINGS

FIG. 1 is an isometric view of the memorial display case of the present invention;

FIG. 2 is a front view of the memorial display case of the present invention;

FIG. 3 is a left side view of the memorial display case of the present invention;

FIG. 4 is a broken, right side view of the memorial display case of the present invention;

FIG. 5 is a cross-sectional view taken along line 5-5 of FIG. 4;

FIG. 6 is a segmental view, partly in cross-section, depicting removal of a transparent panel on one of the compartments;

DETAILED DESCRIPTION OF THE SHOWN EMBODIMENT

Figure 7:
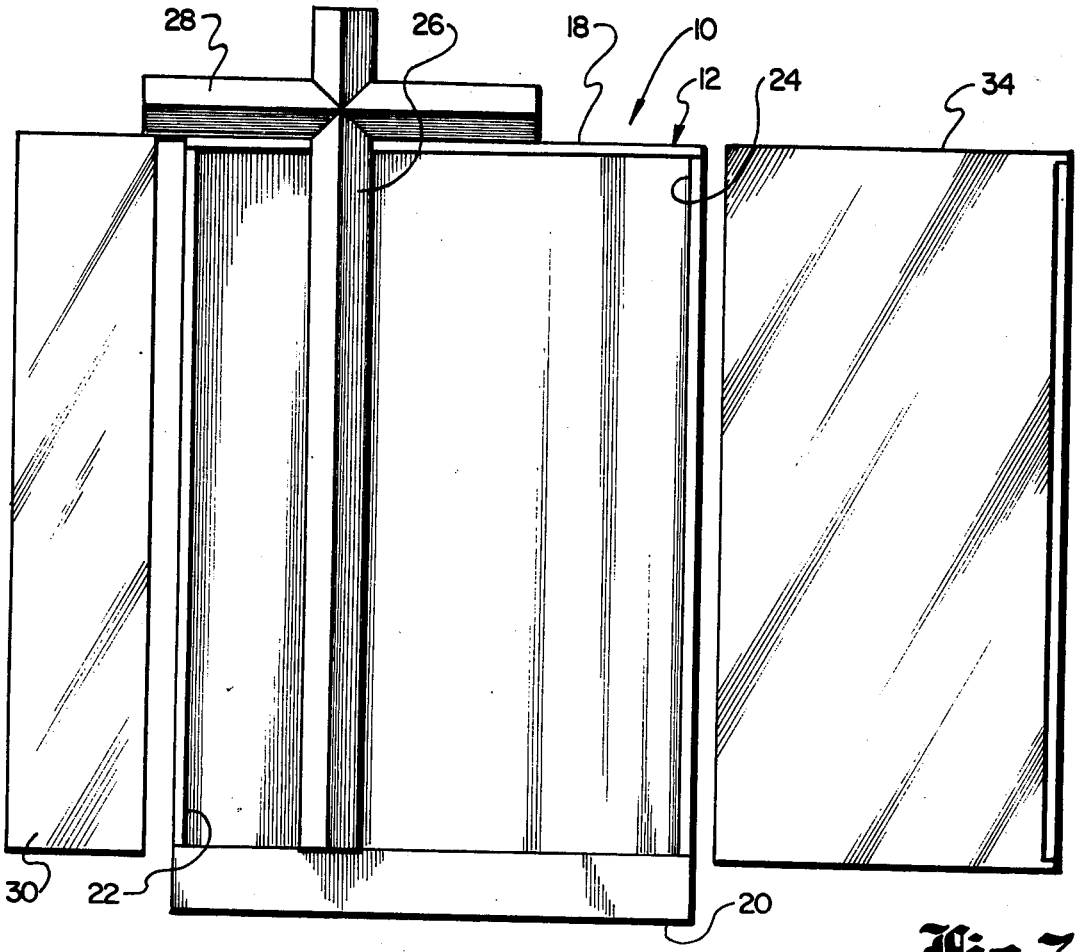
FIG. 7 is a front view similar to FIG. 2 but showing both transparent panels slightly spaced from the memorial case.
Figure 8:
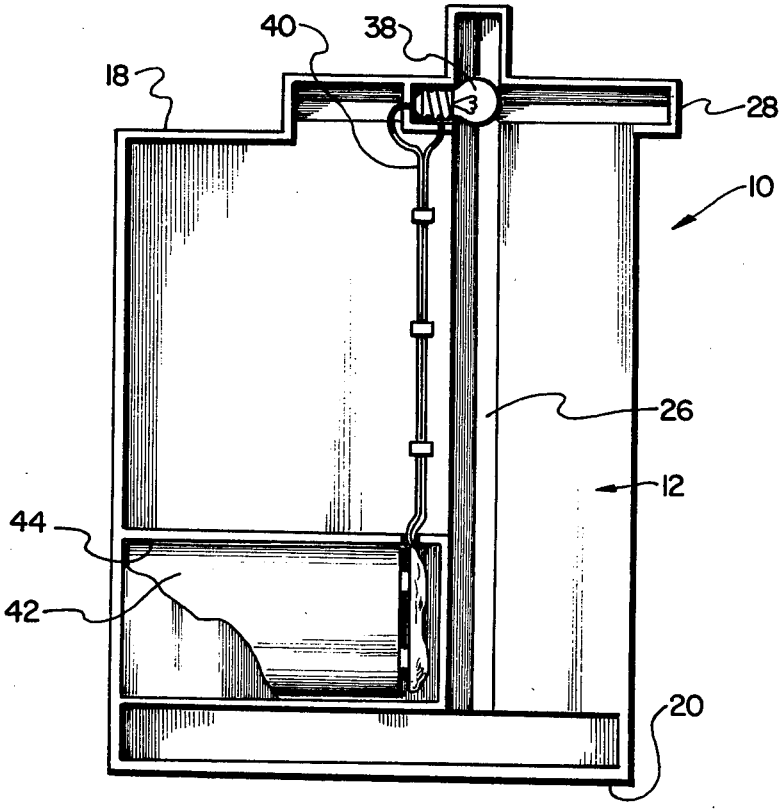
FIG. 8 is a back view of the memorial case of the present invention showing the addition of a lighting means in conjunction therewith.

Referring particularly to the drawings, there is shown the memorial display case 10 if this invention. The display case includes a housing 12 which is to be constructed of any convenient rigid material, such as plastic, wood or the like. The housing 12 has a front surface 14, a back surface 16, a top surface 18 and a bottom surface 20.

Formed within the housing 12 and being open through appropriate access openings to the front surface 14 are a first compartment 22 and a second compartment 24. It is to be noted that the compartment 22 is substantially deeper than the compartment 24. However, also the compartment 24, in cross-section, is substantially greater in size than the compartment 22. The purpose of the compartment 22 is to hold an article, such as a flower. The purpose of the compartment 24 is to display written material, such as the notice which has been printed or written on a piece of paper. Each of the compartments 22 and 24 are closed on three sides except for their respective access openings through the front surface 14.

Dividing the compartments 22 and 24 and integrally formed within the housing 12 is an elongated, upright member 26. Attached to and transversely extending from the upright member 26 is a transverse elongated member 28. The transverse elongated member 28 is mounted in abutting contact with the top surface 18. It is to be noted that the elongated member 28 is substantially shorter in length than the elongated member 26. The acutal design of the combined members 28 and 26 is of a cross which is known as a cruciform.

The compartment 22 is normally closed by means of a transparent sheet (normally plastic) panel 30. The panel 30 is slidingly removable within a groove assembly 32 formed within the housing 12.

Similarly, a larger in size transparent panel 34 is slidingly removable in conjunction with a groove assembly 36 also formed within the housing 12. The panel 34 is located across the access opening for the compartment 24 and is adapted to normally close the compartment 24.

Each of the panels 30 and 34 permit observation into each of the compartments 22 and 24. It is to be understood that upon removal of each of the panels 30 and 34 that access into each of the compartments 22 and 24 is provided.

To facilitate usage of the display case 10 at night, a light 38 may be mounted with the back side 16 at the junction of elongated members 26 and 28. If the members 26 and 28 are constructed of a particular type of plastic, the cruciform will be illuminated which will result in sufficient illumination of compartments 22 and 24 so as to readily observe the contents of these compartments at night. The light 38 is connected to a power source 42 by means of electrical conducter 40. The power source 42 can take a conventional type of battery. The battery source 42 is to be mounted within an appropriate compartment 44 mounted within the back side 16 of the housing 10.

What is claimed is:

1. A memorial display case comprising:

a housing having a front side, a back side, a top surface and a bottom surface;

a first compartment formed within said housing, said first compartment having a first access opening located at said front side, said first access opening being normally closed by a first transparent window, said first transparent window being removably connected to said housing permitting access into said first compartment;

a second compartment formed within said housing, said second compartment having a second access opening located at said front side, said second compartment being substantially greater in cross-sectional size than said first compartment, said second compartment being normally closed by a second transparent window, said second transparent window being removably connected to said housing to permit access into said second compartment; and a cruciform attached to said housing, said cruicform comprising an upright elongated member to which is transversely attached a transverse elongated member, said upright elongated member being located between said first compartment and said second compartment.

2. The memorial display case as defined in claim 1 wherein:

said transverse elongated member being in contact with said top surface.

3. The memorial display case as defined in claim 1 wherein:

lighting means mounted in conjunction with said cruiciform, said lighting means to function to illuminate both said first compartment and said second compartment.

* * * * *